United States Patent [19]

Fujita

[11] Patent Number: 4,652,872

[45] Date of Patent: Mar. 24, 1987

[54] MATRIX DISPLAY PANEL DRIVING SYSTEM

[75] Inventor: Yuji Fujita, Hirakata, Japan

[73] Assignee: NEC Kansai, Ltd., Otsu, Japan

[21] Appl. No.: 625,905

[22] Filed: Jun. 28, 1984

[30] Foreign Application Priority Data

| | | | |
|---|---|---|---|
| Jul. 7, 1983 | [JP] | Japan | 58-124523 |
| Oct. 18, 1983 | [JP] | Japan | 58-195812 |
| Oct. 18, 1983 | [JP] | Japan | 58-195813 |

[51] Int. Cl.[4] ..... G09G 3/12

[52] U.S. Cl. ..... 340/781; 340/789; 340/805; 358/213; 358/241

[58] Field of Search ..... 340/789, 781, 805; 358/241, 212, 213

[56] References Cited

U.S. PATENT DOCUMENTS

| | | | |
|---|---|---|---|
| 3,627,924 | 12/1971 | Fleming et al. | 358/241 |
| 3,634,849 | 1/1972 | Nishizawa | 340/719 |
| 3,793,628 | 2/1974 | Gaur | 340/789 |
| 4,152,626 | 5/1979 | Hatta et al. | 340/781 |
| 4,180,762 | 12/1979 | Weber | 340/789 |
| 4,233,632 | 11/1980 | Akiyama | 358/212 |
| 4,338,598 | 7/1982 | Ohba et al. | 340/789 |
| 4,366,504 | 12/1982 | Kanatani | 358/241 |
| 4,456,909 | 6/1984 | Takahara et al. | 340/781 |
| 4,479,120 | 10/1984 | Ohba et al. | 340/781 |
| 4,485,379 | 11/1984 | Kinoshita | 340/805 |
| 4,496,980 | 1/1985 | Pfleiderer et al. | 358/213 |

*Primary Examiner*—Marshall M. Curtis

*Attorney, Agent, or Firm*—W. G. Fasse; D. H. Kane, Jr.

[57] ABSTRACT

A driving system for a display panel wherein a large number of data lines and scan lines are arranged in matrix fashion and wherein a display cell is disposed at each crossing point includes a row drive for supplying a first voltage to row side electrodes through the scan lines, a column drive for supplying a second or a third voltage to column side electrodes through the data lines, and a refreshing drive for supplying a reverse polarity voltage between the electrodes of each display cell after scanning of all the scan lines. The column drive performs a modulation drive by applying the voltages from the data lines selectively to the display cells according to an intended luminescence or non-luminescence of the cells. The row drive performs a write drive by sequentially applying the first voltage to the scan lines. The refreshing drive performs a refreshing operation by applying a predetermined refreshing voltage to the display cells after completion of the modulation and write drives. Thus, an image is displayed. This system obviates a pre-charge step and hence increases the scanning speed and reduces the power consumption.

8 Claims, 10 Drawing Figures

DATA (COLUMN) LINE
SCAN (ROW) LINE
15
V1(200v)
S
D1
D2
Dm
S1
S2
Sn
SS1
SS2
SSn
D1
D2
Dn
EL11
EL12
EL1m
EL21
EL22
EL n1
EL nm
D
13
17
VR(200v)
SC2
11'
SD1
SD2
SD3
SDm
14
V2(60v)
12
SC1
16
V3(0v)
11

DATA (COLUMN) LINE
SCAN (ROW) LINE
15
V1(200v)
S
D1
D2
Dm
S1
S2
Sn
SS1
SS2
SSn
D1
Dn
EL11
EL1m
EL n1
EL nm
D
13
17
VR(200v)
SC2
SD1
SD2
SDm
14
V2(60v)
12
SC1
16
V3(0v)
11

DATA (COLUMN) LINE
V1(200v)
D1
D2
D3
Dm
SP1
SN1
SP2
SN2
SP3
SN3
SPn
SNn
S1
S2
S3
Sn
EL11
EL12
EL13
EL1m
EL21
EL31
ELn1
ELnm
SCAN (ROW) LINE
V2(60v)
32(33)
DP1
DP2
DP3
DPn
Dd1
Dd2
Dd3
Ddn
DN1
DN2
DN3
DNm
31

1H'
a
FLOATING
S1
S1G1
ON
S1G2
S2
S2G1
S2G2
S3
DATA

MATRIX DISPLAY PANEL DRIVING SYSTEM

BACKGROUND OF THE INVENTION

1. Field of the Invention

The present invention relates to a matrix display panel driving system and particularly to an electroluminescent (EL) panel driving system capable of attaining a high speed scanning and a low power consumption.

2. Description of the Prior Art

A display panel having a large number of data lines and scane lines arranged in a matrix form and display cells, such as liquid crystal or EL display cells disposed at crossing points, is known as a matrix image display device. For example, a thin film EL image display panel is disclosed in U.S. Pat. No. 4,366,504 in which a brilliance modulation is performed by changing the voltage of data line side electrodes. However, as a matrix drive for this type of EL panel, there usually is adopted a so-called pre-charge type line sequential drive which drive is performed after going through a preliminary charge. Due to this pre-charge step, the power consumption increases and a pre-charge drive period of about 10–20 μsec is required for each selected scan line, so the frame frequency is restricted and thus such driving system is not suitable for a high speed scanning.

SUMMARY OF THE INVENTION

It is an object of the present invention to provide a matrix display panel driving system dispensing with the conventional pre-charge step and capable of attaining both a high speed drivability and a low power consumption. More particularly, a primary object of the present invention is to provide a novel and improved direct type line sequential driving system for a plane display panel. Disclosed herein is a direct line sequential driving system including a modulation drive from or through a data line, a write drive from or through a scan line and further a refreshing drive from or through either line, in which the conventional pre-charge step is substantially excluded.

It is another object of the present invention to simplify a drive circuit in a direct type sequential drive by performing a refreshing drive from the scan line side by utilization of a write drive means, and particularly to attain a low power consumption by dividing scan lines into blocks and performing a refreshing drive in a time-sharing fashion.

It is a further object of the present invention to simplify the circuit configuration for the convenience of circuit integration by using push-pull drivers as column and row drive means connected respectively to data lines and scan lines thereby allowing the row drive means on the scan line side to be used also as a refreshing drive means. Additionally, the use of push-pull drivers as the row drive means accelerates the operation start point of a line sequential drive in a discharge operation which follows a charge operation in a write drive for scan lines, whereby the horizontal blanking period is shortened in each scanning period and a faster drive is achieved. More particularly, by facilitating the selection of a write start timing when shifting from one selected scan line to the next, the scanning is accelerated and the power consumption during discharge is reduced.

The driving system of the present invention for a matrix display panel having a large number of data lines and scan lines arranged in a matrix fashion and display cells disposed at crossing points of the matrix, includes a row drive means for supplying a first voltage from or through scan lines to the row side electrodes of the display cells, a column drive means for supplying second and third voltages from or through data lines to column side electrodes of the display cells, and a refreshing drive means for supplying a reverse polarity voltage between both electrodes of each display cell after scanning of all the scan lines. In one mode of use of the refreshing drive means, a refreshing voltage supply terminal and a switch circuit are provided in the column drive means side to supply a reverse polarity voltage through a data line, while in another mode of its use, the row drive means is used also as the refreshing drive means to supply a reverse polarity voltage through a scan line.

Particularly, the latter, namely, utilizing the row drive means directly as a refreshing drive means, is extremely significant from the standpoint of simplification of the circuit configuration. In this case, a refreshing drive is performed sequentially through scan lines (group) selected in a block by block fashion and as a time-sharing operation after dividing the scan lines into blocks. More particularly, there is provided a driving system for performing a luminous display on an EL panel without going through a pre-charge step by selectively making luminous a large number of matrix-like arranged EL elements, which driving system includes a row drive means for driving scan lines sequentially with a first voltage which exceeds a threshold level of a required luminescence voltage, a column drive means for applying a third voltage for luminescence or a second voltage for non-luminescence to selected or non-selected EL elements on data lines in accordance with a scanning period, and a refreshing drive means for applying to EL elements a high voltage with a polarity reverse to that of the required luminescence voltage, the row drive means being used also as the refreshing drive means to simplify the circuit configuration.

According to one aspect of the present invention, there is disclosed a direct line sequential driving system in which a first voltage $V_1$ is applied by the row drive means in a line sequential manner to one electrode of EL elements connected to crossing points of the scan lines and data lines, thereby performing a write drive, while a second voltage $V_2$ (for non-liminescence) or a third voltage $V_3$ (luminescence) is applied to the other electrodes by the column drive means, whereby a pre-charge drive is obviated. The refreshing drive means is attached to the column drive means side, or alternatively the row drive means is used also as the refreshing drive means. In the latter case of common use, the scan lines are divided into two blocks, one block comprising first scan lines (or groups), and the other block comprising second scan lines (or groups) and the remaining scan lines (or groups), then a first voltage is applied between both blocks and a divided voltage inversely proportional to the capacitance value of both blocks, is applied as a reverse polarity voltage to EL elements on the first block of scan lines (or groups) to effect a refreshing drive. In this way, a refreshing drive is performed by the first to second block of scan lines in a time-sharing manner. It is to be noted that the refreshing voltage is determined according to the capacitance value of the blocks. For example, if the blocks are composed of four groups of scan lines and the EL elements all have substantially the same capacitance value, a refreshing voltage corresponding to $\frac{3}{4}$ of the above mentioned first voltage is applied at a reverse polarity to one group of scan lines at a time. In this way, refreshing for each scan line group is repeated four times in a time-sharing manner.

According to another aspect of the present invention, the column and row drive means of the driving system comprise push-pull switch circuits as drivers. The first voltage supplied by the row drive means is applied to only a selected scan line in a line sequential manner to perform a write drive, while the other unselected scan lines are brought into a floating state of high impedance. The write drive includes a charge step under a pushing operation for applying the first voltage and a discharge step just thereafter at a grounded state under a pulling operation. In the present invention, the second selected scan line is started to charge during a pushing operation in the discharge step of the first selected scan line to shorten the horizontal blanking period between scanning pulses, namely, to set the frame frequency high, thereby attaining a high speed scanning. During the scan period, after selection of a specific scan line, the floating state is maintained without discharge of all the EL elements, whereby the power consumption has been reduced.

The driving system described hereinabove basically includes a modulation drive effected by a charge and discharge from data lines, a write drive effected by a charge and discharge from scan lines and a refreshing drive effected through data lines and/or scan lines, whereby one frame of a displayed image is formed. Since a pre-charge operation is avoided the scanning speed is increased and the power consumption has been reduced. Liquid crystal and/or elements can be used as the display cell. The driving system is suitable for driving a thin film EL panel on which are arranged EL elements in a matrix form. In this case, the EL elements have each a predetermined threshold level ($V_{EL}$) in the form of a required luminescence voltage. Thus, for causing luminescence of a selected EL element, a voltage above the threshold level is applied by the column drive means. More particularly, for the first voltage $V_1$ supplied from a scan line, a third voltage $V_3$ is fed from a data line, whereby the relationship of the voltage applied to an EL element is as follows: $(V_1-V_3)>V_{EL}$. Conversely, for making the EL element non-luminous, the second voltage $V_2$ is fed to the data line and the voltage $(V_1-V_2)<V_{EL}$ is applied to the EL element. The ground potential is selected as the third voltage for simplification of the circuit configuration.

Two types of a refreshing drives are provided. One type of refreshing drive is disposed on the column drive means side, and a switch circuit is used for switching between refreshing and modulating terminals, that is, switching between a modulation drive and refreshing drive.

According to the other type of refreshing drive, the row drive means is used also as the refreshing drive, and the scan lines (or groups) are refreshed sequentially in a time-sharing fashion. Thus, this is a new type of refreshing method, wherein the scan lines (or groups) are divided into two blocks, and the first voltage from the scanning terminal is applied as a refreshing voltage and at a reverse polarity. Since the refreshing voltage is inversely proportional to the capacitance value of the display cells in the blocks, there is obtained a reverse polarity voltage proportional to the number of times of the division for the refreshing.

In the second refreshing method, moreover, the scanning side row drive means comprises push-pull drive circuits like the data side column drive means, thereby shortening the scanning interval of the so-called horizontal blanking period. In a line sequential write drive there are involved a charging step and a subsequent discharging step, but the aforesaid shoftening can be attained by starting the charging step for the next selected scan line during discharge of a selected scan line. As a result, it becomes possible to achieve a high speed drive. Further, during charging and discharging steps for a selected scan line in the write drive, all the other scan lines are held open or floating at a high impedance, whereby the dissipation of the charge stored in the display cells can be prevented, thus reducing the power consumption.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
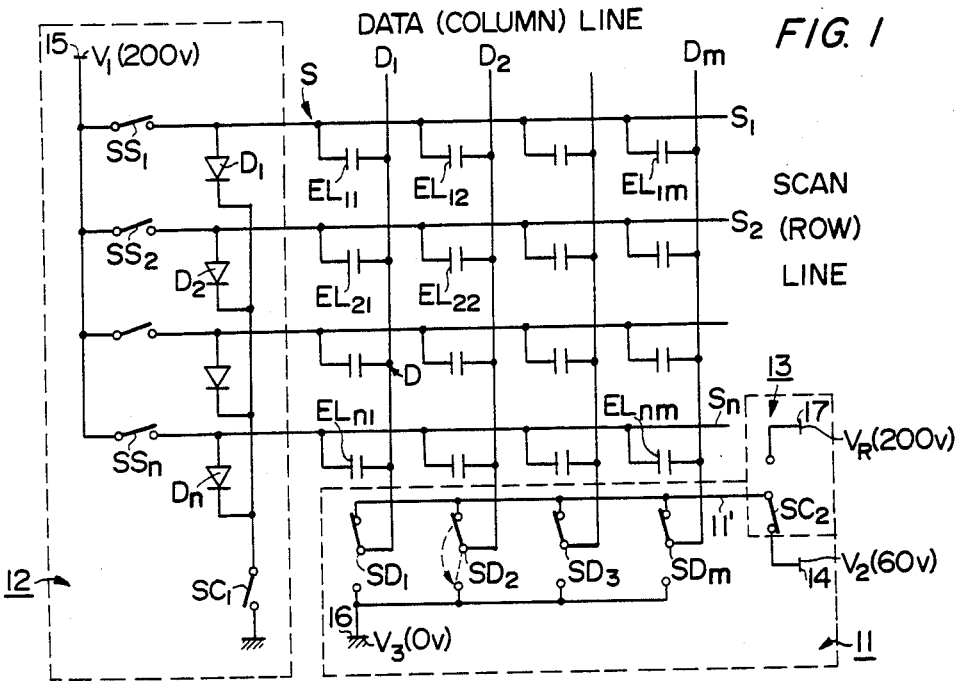
FIG. 1 is a circuit diagram of a display panel driving system embodying the present invention.

First, a direct type line sequential scanning drive system for an EL display panel will be fully described with reference to FIGS. 1 to 3. FIG. 1 schematically illustrates an EL display panel driving system embodying the present invention, in which a column drive means 11, a row drive means 12 and a refreshing drive means 13 are connected to a matrix EL panel 10 constituting an image display panel driving system. In FIG. 1, the letter S represents a group of scanning side electrodes, including a plurality of scan lines $S_1$ to $S_n$, and the letter D designates a group of data side electrodes, including a plurality of data lines $D_1$ to $D_m$. Single throw switching elements $SS_1$–$SS_n$ are connected to the scanning lines or rows $S_1$ to $S_n$, respectively, and to a common first terminal 15 which is supplied with a first voltage $V_1$. Further, the data or columns $D_1$–$D_m$ are connected to the center terminal of respective double throw switching elements $SD_1$–$SD_m$. One switching terminal of these switching elements is connected to a second common terminal 14 which is supplied with a second voltage $V_2$, while the other switching terminals are connected to grounding points which in turn are connected to a third common terminal 16 which is supplied with a third voltage $V_3$. At the crossing points of these scan lines or rows $S_1$–$S_n$ and the data lines or columns $D_1$–$D_m$ are disposed m×n EL display cells $EL_{11}$–$EL_{nm}$.

The column drive means 11 comprise push-pull drivers in the form of the above mentioned double throw switching elements $SD_1$–$SD_m$, whereby the third voltage $V_3$ (OV) is applied through a data line to a selected EL display cell for causing luminescence, while the second voltage $V_2$ (60 V or other suitable value) is applied through the other data lines to unselected display cells to provide a modulating drive. On the other hand, the row drive means 12 include push drivers in the form of the single throw switching elements $SS_1$–$SS_n$ and a single throw switching element $SC_1$ which is connected to the scan lines $S_1$–$S_n$ through diodes $DS_1$–$DS_n$, whereby the first voltage $V_1$ (200 V or other suitable value) is applied sequentially from the first terminal 15 to the scan lines $S_1$–$S_n$ for causing a write drive. Display cells selected in this way are rendered luminous.

Further, the refreshing drive means 13 include a double throw switching element $SC_2$ connected with its center terminal to the common conductor 11' of the column drive means 11 and having a fourth terminal 17 for supplying a refreshing voltage $V_R$ to one switching side or terminal of the switching element $SC_2$. The just described refreshing drive means 13 applies the refreshing voltage $V_R$ (about 200 V) to all the display cells $EL_{11}$–$EL_{nm}$ at a time by utilizing the pull-side operation of the push-pull drivers $SD_1$–$SD_m$ of the column drive means 11 and the conducting operation of the switching element $SC_1$ of the row drive means 12 to provide the refreshing drive. The switching element $SC_2$ performs its switching operation between a modulation drive and refreshing drive, and the circuit diagram of FIG. 2 shows a refreshing drive state.

The switching elements are each in the form of an integrated circuit. For example, the data side switching elements $SD_1$–$SD_m$ are push-pull drivers, and as shown in FIG. 3, the voltage OV is applied to an input terminal IN to render conductive only a push-side MOS transistor $FET_1$, thereby allowing the second voltage $V_2$ (60 V) to appear at an output terminal OUT. Further, a pull-side MOS transistor $FET_2$ alone is rendered conductive by applying 5 V to the input terminal IN, thereby allowing the third voltage $V_3$(OV) to appear at the output terminal OUT.

Figure 4:
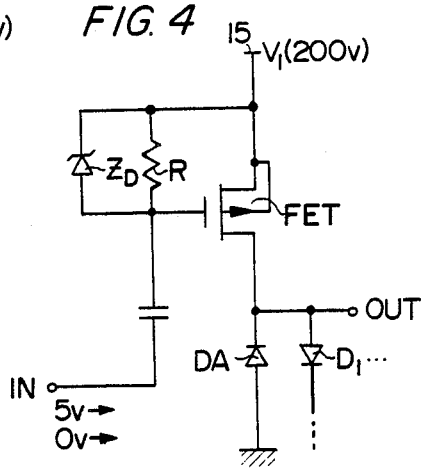
FIG. 4 is a circuit diagram of a principal portion of a row drive means in FIG. 1.

On the other hand, the scanning side switching elements $SS_1$–$SS_n$ comprise push drivers, and as shown in FIG. 4, when an input terminal IN is OV, the first voltage $V_1$ (200 V) appears at an output terminal OUT, while when 5 V is applied to the input terminal IN, the output terminal OUT is held in a floating (open) condition. A diode DA is used for discharging. Thus, each driver is driven with a gate signal of a voltage in the range of OV to 5 V as a general driving voltage range, which is useful for the circuit integration of components and for the stabilization of operations.

The circuit of FIG. 1 operates in the following manner. The scan lines $S_1$–$S_n$ are successively selected upon turning ON of the push drivers and scanned by the first voltage $V_1$. As the first voltage $V_1$, 200 V was selected, which is larger than the threshold level $V_{EL}$ required for causing the luminescence of EL display cells $EL_{11}$–$EL_{nm}$. Data voltage is supplied to the data lines $D_1$–$D_m$ in accordance with a scan timing. As to this data voltage, for example, where the display cell $EL_{22}$ is to be rendered luminous, the switching element $SD_2$, a push-pull driver, is rendered conductive on its pull side for connection by the grounding third terminal 16 to supply the third voltage $V_3$ as shown by a dashed line in FIG. 1. On the other hand, for the selection of non-luminescence, the switching element $SD_2$ is rendered conductive on its push side for connection to the second terminal 14 to supply the second voltage $V_2$, so that a voltage corresponding to the difference relative to the voltage $V_1$ is supplied to the scan line side electrode $D_2$ and hence applied to the display cell $EL_{22}$. Thus, a differential voltage ($V_1$–$V_2$) below about 140 V not exceeding the threshold level of about 160 V required causing luminescence is applied to the display cell $EL_{22}$, the cell becomes non-luminous. Conversely, at a differential voltage ($V_1$–$V_3$) of about 200 V exceeding the above threshold level, the display cell becomes luminous.

Figure 2:
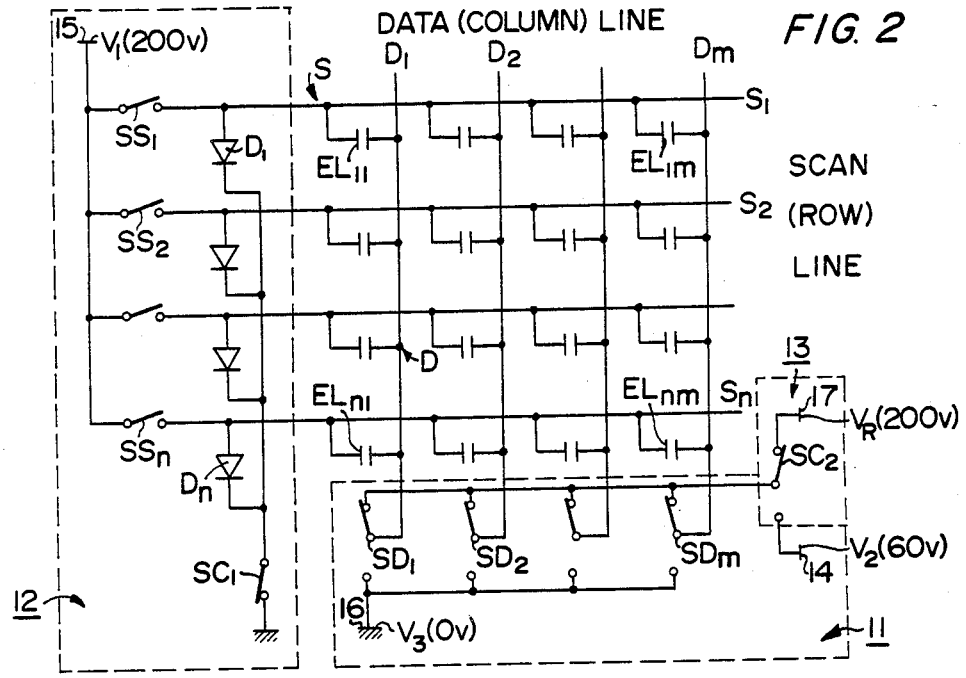
FIG. 2 is a circuit diagram illustrating of a refreshing drive in FIG. 1.
Figure 3:
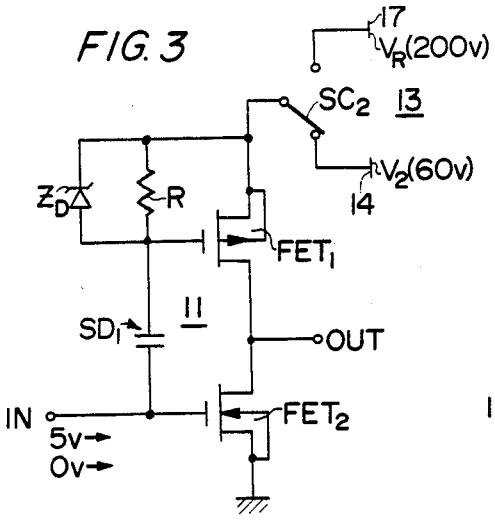
FIG. 3 is a circuit diagram of a principal portion of a column drive means in FIG. 1.

When the selection of all the scan lines $S_1$–$S_n$ is completed, the switching element $SC_1$ of the row drive means 12 is rendered conductive to ground (OV) the scan lines or rows $S_1$–$S_n$, then the push drivers $SD_1$, . . . , of the column drive means 11 are rendered conductive and the switching element $SC_2$ is connected to the fourth terminal 17 which is supplied with the refreshing voltage VR, as shown in FIG. 2. As a result, the refreshing voltage is applied through the data lines $D_1$–$D_m$ to effect refreshing. The refreshing period is 20 to 30 μsec.

According to the above embodiment, the scan line and data line drive circuits can be operated at control input voltages of OV and 5–10 V, whereby it is possible to attain a circuit integration of components and the stabilization of the switching operations, resulting in a highly reliable drive. Particularly, since pre-charge is not needed, it is possible to attain both a high speed drive at a high frame frequency and reduction of the power consumption.

Figure 5:
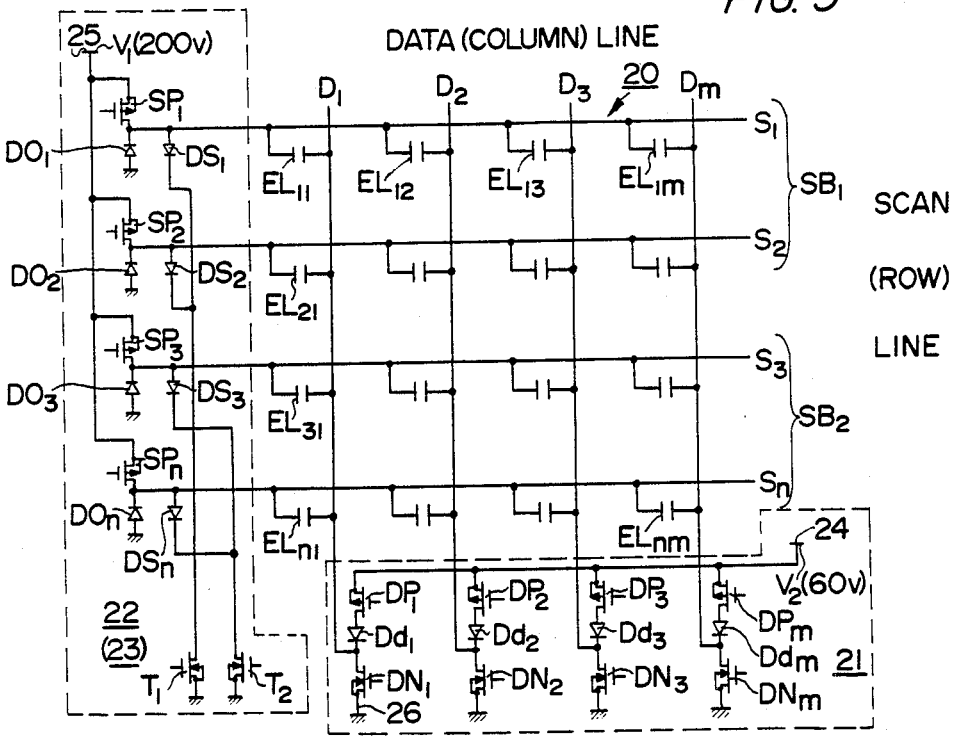
FIG. 5 is a circuit diagram of another display panel driving system embodying the invention.

FIG. 5 illustrates another preferred embodiment of the present invention, in which a row drive means is used also as a refreshing drive means to realize a novel time-sharing refreshing system. In the matrix type EL display panel shown in FIG. 5, like in FIG. 1, a large number of data lines or columns $D_1$–$D_m$ and scan lines or rows $S_1$–$S_n$ are arranged in a matrix form and EL display cells $EL_{11}$–$EL_{nm}$ are disposed at the crossing points. This image display panel 20 called a thin-film EL panel is provided with a drive circuit 21 for the data lines $D_1$–$D_m$. The drive circuit 21 comprises push-pull type column drive means including push drivers $DP_1$–$DP_m$, diodes $Dd_1$–$Dd_m$ and pull drivers $DN_1$–$DN_m$. The panel 20 is also provided with a drive circuit 22 for the scan lines or rows $S_1$–$S_n$. The push type row drive circuit 22 includes push drives $SP_1$–$SP_n$, reverse current preventing diodes $DS_1$–$DS_n$, discharging diodes $DO_1$–$DO_n$ and switching elements $T_1$ and $T_2$ for scan line blocking. The row drive means 22 functions also as a refreshing drive means 23, whereby a time-sharing refreshing is realized as will be described below.

The operating or data voltages for the column drive means 21 are provided by a second voltage $V_2$ for causing non-luminescence, applied to a second terminal 24, and a third voltage $V_3$ for causing luminescence is obtained by grounding a third terminal 26. Consequently, a luminescence (OV) or non-luminescence (60 V) data voltage is applied to selected EL display cells under an ON-OFF control of the push drivers $DP_1$–$DP_m$ and of the pull drivers $DN_1$–$DN_m$. On the other hand, the operating voltage for the row drive means 22 includes a first voltage $V_1$ at a required luminescence level exceeding a threshold level $V_{EL}$ required for causing luminescence of each display cell and applied to a first terminal 25. Its value is set at 200 V for the threshold level of about 150–170 V. The threshold level $V_{EL}$ is determined according to the structure of a display cell, and the first voltage $V_1$ is determined according to the EL display cell used. The construction of the refreshing drive means 23 is common with that of the row drive means 22, and a required refreshing voltage of a reverse polarity is produced by using the first voltage $V_1$.

In the above construction, the following process is executed for forming one frame. (1) Modulation Drive (data side), the data lines are set to the data voltage for causing luminescence with the third voltage, or for causing non-luminescence with the application of the second voltage. (2) Write Drive (scan side), after the data setting, the voltage level is set to the required luminescence level with the first voltage in a line sequential manner from the scan lines. (3) Refreshing Drive (scan side), after scanning of all the scan lines, the data lines are brought into a floating state and pulses of a reverse polarity are applied. In this case, the scan lines are divided into blocks and refreshing is performed in a time-sharing manner. In this connection, the first voltage $V_1$ is utilized in a divided form on the basis of an interblock capacity ratio.

Figure 6:
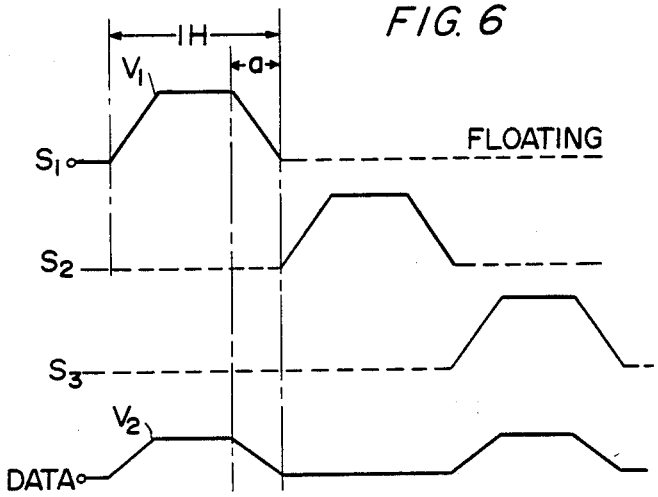
FIG. 6 is a timing characteristic diagram illustrating the operations of the circuit of FIG. 5.

The above operations will now be described in detail with reference to the time chart of FIG. 6. First in the modulation drive, the push drivers $DP_1$–$DP_m$ and the pull drivers $DN_1$–$DN_m$ are controlled to charge the data lines with the second or third data voltage $V_2$ or $V_3$. Then in the write drive, the first voltage $V_1$ is applied to a selected scan line charging step and the luminescence or non-luminescence of selected display cells is caused. Thereafter, the switching element $T_1$ or $T_2$, shown in FIG. 5, is turned ON to allow the EL display cells to discharge. In this way, the modulation and write drives are carried out in all the scan lines.

Figure 7:
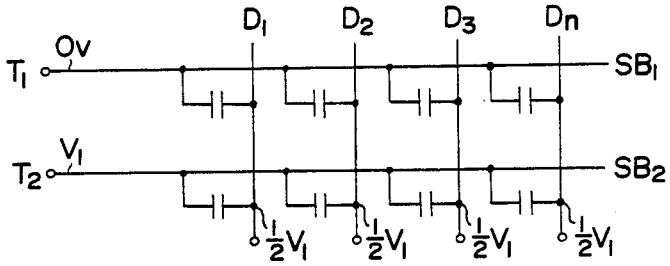
FIG. 7 is a circuit diagram of a principal portion of a refreshing drive in FIG. 5.
Figure 8:
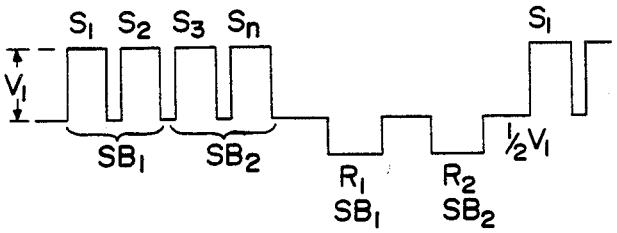
FIG. 8 is a diagram illustrating the timing characteristics of the circuit of FIG. 7.

The refreshing drive which is performed after the scanning of all the scan lines, will now be explained with reference to FIGS. 7 and 8. The scan lines $S_1$–$S_n$ are divided into two blocks, a first line block $SB_1$ and a second line block $SB_2$, please see also FIG. 5. The first switching element $T_1$ is conducting to ground and at the same time the push drivers $SP_3$ and $SP_n$ are rendered conductive to supply the first voltage $V_1$ to the second line block $SB_2$. At this time, the switching element $T_2$ is switched off. As a result, a reverse polarity voltage is applied to the EL display cells of the first line block $SB_1$. This reverse polarity voltage is inversely proportional to the capacitance values of the display cells of the other line block. As shown in the figures, when the capacitance values are 1:1, a refreshing voltage of $\frac{1}{2}$ $V_1$ is produced. At this time, the data line side is in a floating state. The second line block $SB_2$ is refreshed, in the same way, and in this way refreshing of all the scan lines is completed in a time-sharing fashion.

In the construction and operation described above, firstly, since pre-charging operations are not included, it is possible to attain both a reduced power consumption and a high speed drive. Secondly, the circuit configuration can be simplified because the refreshing drive and the write drive are executed by the same circuit means, that is, by the row drive means 22, or the refreshing drive means 23. This also leads to a reduction of the cost of the driving system and thus is very advantageous in practical use. Thirdly, the divided refreshing system permits selection of a refreshing voltage according to a divided line group capacitance values between blocks. For example, when scan lines are divided into two blocks, $\frac{3}{4}$, i.e. 150 V, for the first voltage $V_1$ of 200 V can be utilized as a reverse polarity voltage for the refreshing operation. Besides, if the data lines $D_1$–$D_m$ are held in a floating state after application of the second voltage $V_2$, the 60 V of the latter can be added to 150 V of the reverse polarity voltage, and thus a refreshing voltage of 210 V can be obtained.

Figure 9:
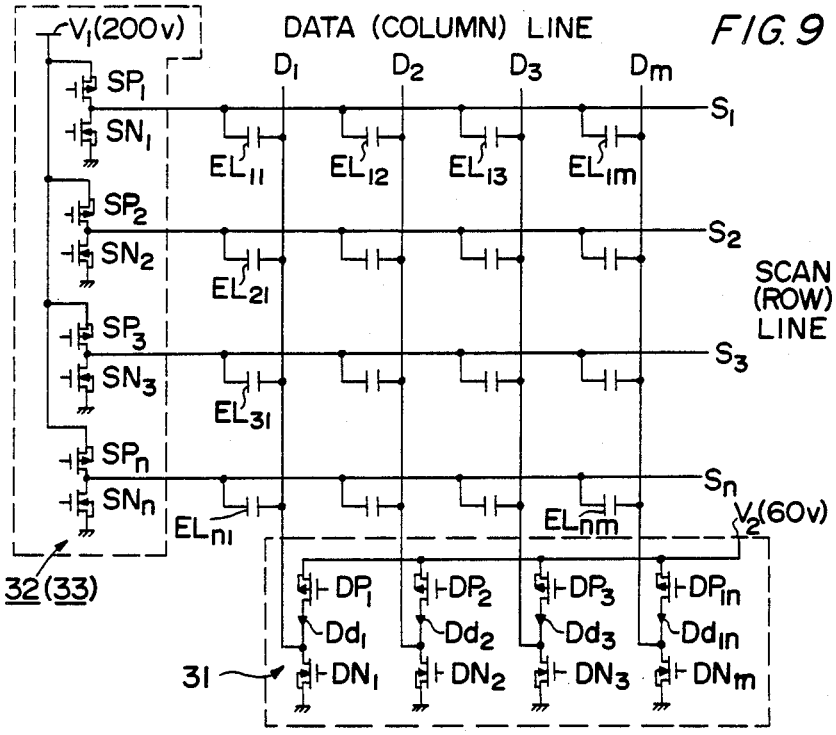
FIG. 9 is a circuit diagram of a display panel driving system according to a further preferred embodiment of the present invention.

FIG. 9 illustrates a further preferred embodiment of the present invention, in which a row drive circuit 32 and a refreshing drive circuit 33 of a construction common to the former are constituted by a push-pull switch circuit which comprises such switches $SP_1$–$SP_n$ and pull switches $SN_1$–$SN_n$. A column drive circuit 31 comprises push-pull drivers as in the embodiment of FIG. 5.

Figure 10:
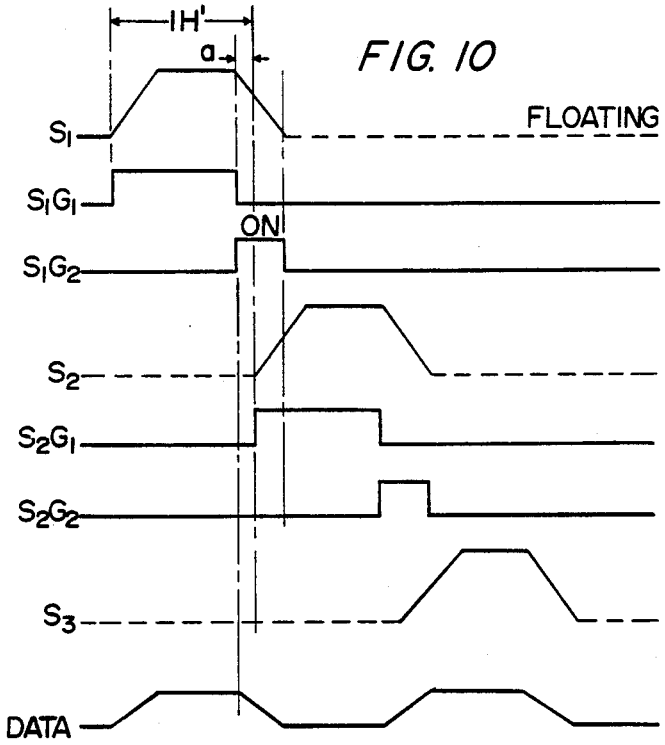
FIG. 10 is a timing characteristic diagram illustrating the operations of the circuit of FIG. 9.

In operation, the column drive circuit 31 applies data voltage $V_2$ or $V_3$ from data lines $D_1$–$D_m$ to charge the latter. On the other hand, the row drive circuit 32 applies the required luminescence voltage $V_1$ to a selected scan line $S_1$ to charge the latter. This operation is started by applying a gate signal $S_1G_1$ to the push driver $SP_1$ in the time chart of FIG. 10. This charging step is completed upon switching of the signal $S_1G_1$, followed by execution of a discharging step by applying a gate signal $S_1G_2$ to the pull driver $SN_1$. Thereafter, the push and pull drivers $SP_1$ and $SN_1$ are rendered non-conductive and held at a high impedance in a floating state. The above modulation and write drives are performed in a line sequential manner. In this connection, one feature of the present invention is that the second selected scan line $S_2$ begins to be charged during the discharge step of the first selected scan line $S_1$, that is, the push driver $SP_2$ is rendered conductive by a gate signal $S_2G_1$. This charging step is transferred to the discharging step by supplying a gate signal $S_2G_2$, and after completion of the write drive, the scan lines are held in a floating state. Thus, the charge of one selected scan line can be started during discharge of the previous scan line by the use of the push-pull drivers, and as a result it becomes possible to shorten the scanning interval (horizontal blanking period) for attaining a higher speed drive.

After completion the scanning of all the scan lines, a refreshing drive is performed in a time-sharing fashion. This operation may be explained by using the equivalent circuit of FIG. 7 and the time chart of FIG. 8. If the number of scan lines $S_1$–$S_n$ is four, a refreshing drive for the scan line $S_1$ is carried out while dividing the scan lines $S_1$–$S_n$ into two blocks which are a first line block $SB_1$ of scan line $S_1$ and a second line block $SB_2$ of the remaining scan lines $S_2$–$S_n$. After refreshing of the first selected scan line $S_1$, second and third scan lines are sequentially selected until all the scan lines are refreshed by repetition of the same operation. This refreshing method is an important feature of the present invention.

Actually, on a thin-film EL display panel having 240×320 display cells as the EL display panel 20, an image was displayed using push-pull drivers on both column and row sides as shown in FIG. 9. The frame frequency was set at 60 Hz and the write voltage $V_1$ at 233 V to obtain a luminance of 25 foot-lambert (85.7 $Cd/m^2$). In this case, the refreshing drive is inevitably carried out in a time-sharing fashion. Each scanning period was about 60 μsec whereby the pulse width and the refreshing pulse width were about 120 μsec. In narrowing the scanning pulse width for speed-up, it has been found difficult to make it narrower than 10 μsec. This indicates that the omission of the pre-charged step is an important factor for a high speed drive. Additionally, in connection with the power consumption, the following data were obtained as measured values:

| | Power Consumption (W) | | |
|---|---|---|---|
| | Voltage (V) | Min | MAX |
| Modulation Drive | 60 | 0.02 | 7.5 |
| Write and Refreshing Drive | 229 | 1.5 | 2.1 |
| Total | | 1.52 | 9.6 |

The time-sharing refreshing drive systems shown in FIGS. 5 to 10 are advantageous to the simplification of circuit configuration and also because they provide a lower power consumption and a faster drive. Particularly, when the write drive is performed by scanning, in these embodiments, the scan lines other than a selected scan line are held in a floating state of high impedance, the dissipation of the stored charge can be prevented and the power consumption is thereby reduced. Power saving is attainable also in the modulation drive in the case where the data voltage does not change.

The direct line sequential driving system of the present invention dispenses with the pre-charge step or period and thereby reduces the amount of power required, which is advantageous to the realization of a faster drive at a lower power consumption. Moreover, since the row drive means can be used also as a refreshing drive means, not only it the construction simplified but also the costs of the driving system are reduced. Besides, the time-sharing type refreshing drive permits an easier selection of a refreshing voltage. Further, since the write drive is started in an earlier stage, the high-speed drivability can be further improved.

What is claimed is:

1. A driving system for a matrix display panel having a plurality of display cells in which a multitude of data lines and scan lines are arranged in columns and rows in a matrix fashion, and wherein each of said display cells has a capacitance and electrodes connected to each crossing point of said rows and columns in the matrix, comprising row input means connected to said scan lines and column input means connected to said data lines, row drive means connected to said row input means for supplying a first voltage ($V_1$) through said scan lines to said display panel, column drive means connected to said column input means for supplying one of two further voltages including a second and third voltage ($V_1$,$V_2$) through said data lines to said display panel, and refreshing drive means connected for supplying a reverse polarity voltage between said electrodes of each display cell after scanning of all said scan lines, in which driving system said column drive means perform a charge step for each display cell as a modulation drive by selectively applying the voltages through said data lines to said display cells according to an intended operation of said display cells, wherein said row drive means perform a write drive including a charge step by applying said first voltage to said scan lines which are sequentially selected, and a discharge step immediately after the charge step of each scan line by switching to ground potential, and wherein said refreshing drive means performs a refreshing drive by applying a predetermined refreshing voltage to said display cells after completion of said modulation and write drives for forming one image display frame, said first, second and third voltages being set so that the difference between said first and second voltages and the difference between said first and third voltage are respectively smaller and larger than a voltage threshold level ($V_{EL}$) required for luminescence of each of said display cells, thus $(V_1-V_2)<V_{EL}<(V_1-V_3)$, and wherein said third voltage is ground potential thereby simplifying said column drive means and permitting a prompt luminescent operation without any precharging.

2. The driving system of claim 1, wherein said refreshing drive means comprise a switch circuit and a refreshing voltage terminal both provided in said column drive means, and wherein said predetermined refreshing voltage is applied from said refreshing voltage terminal to said display cells through said data lines by switching said switch circuit from a modulation drive to a refreshing drive.

3. The driving system of claim 1, wherein said row drive means comprise a plurality of push switch circuits for each of said scan lines connected to a first terminal for supplying said first voltage sequentially to said scan lines, and wherein said column drive means comprise a plurality of push-pull swith circuits for each of said data lines connected to a second terminal for supplying said second volage and to a third terminal for supplying ground potential as said third voltage, whereby a pushing operation of said push-pull switch circuits connects said data lines to said second terminal, and whereby a pulling operation of said push-pull switch circuits connects said data lines to said third terminal, for selectively supplying one of said second and third voltages to said display cell in a direct line sequential drive having one pulse for each scan period without going through a pre-charge step.

4. The driving system of claim 1, wherein said row drive means comprise a first terminal for supplying said first voltage, a push type first switching element connected to said first terminal for supplying said first voltage to said first push type switching element, said row drive means further including a second switching element connected for discharging said display cells, and wherein said refreshing drive means comprise said first terminal and said first and second switching elements of said row drive means for performing a refreshing drive by utilization of said first voltage supplied by said first terminal.

5. The driving system of claim 1, wherein said column drive means comprise a second terminal for supplying said second voltage, a third terminal for supplying said third ground potential voltage, and a push-pull switch circuit connected to said second and third terminals, said push-pull switch circuit controlling said data lines for establishing any of the following three states, a first state in which said second voltage is applied to the data lines, a second state in which said third voltage is applied to said data lines, and a third floating state in which neither voltage is applied to said data lines, wherein said row drive means comprise a first terminal for supplying said first voltage ($V_1$) and a push type switching circuit connected to said first terminal for supplying said first voltage, and a pull type switching circuit connected to said scan lines for switching said scan lines between grounding and floating states, said push type switch circuit performing said charge step as part of said write drive said pull type switch circuit performing said discharge step also as part of said write drive, and wherein said refreshing drive means comprise said row drive means in which said predetermined refreshing voltage is provided by said first voltage supplied by said first terminal.

6. The driving system of claim 1, wherein said row drive means comprises a plurality of pull type switch circuits connected to a predetermined number of scan lines, said pull type switch circuits being divided into two, selected and unselected blocks, and wherein said refreshing drives means is connected to the selected blocks for refreshing said scan lines associated with the selected blocks in a time-sharing manner.

7. The driving system of claim 1, wherein said column and row drive means each comprise a push-pull drive circuit, said row drive means being adapted for operating also as said refreshing drive means, wherein said first voltage is applied as said predetermined refreshing voltage to a first group of said display cells connected to a selected scan line through a second group of said display cells connected to an unselected scan line, wherein said push-pull drive circuit performs in its write drive a line sequential scanning while executing a charging step as part of said write drive by its pushing operation and a discharging step also as part of said write drive by its pulling operation, said push-pull drive circuit thereafter performing a refreshing drive in a time-sharing fashion, and wherein in said write drive said charging step for a second scan line which follows said charging and discharging steps for a first scan line, is started during the discharging step for the first scan line, thereby shortening the horizontal blanking period between scan lines.

8. The driving system as set forth in claim 1, wherein said display cell comprises an electroluminescence (EL) element, and said display panel is a thin-film EL panel with a multitude of EL elements arranged in a matrix fashion.

* * * * *